US011830687B2

(12) United States Patent
Fu

(10) Patent No.: US 11,830,687 B2
(45) Date of Patent: Nov. 28, 2023

(54) SHAFT AND KEYBOARD

(71) Applicant: DONGGUAN HEATMOVING ELECTRONIC TECHNOLOGY CO., LTD., Guangdong (CN)

(72) Inventor: Jiang Fu, Dongguan (CN)

(73) Assignee: DONGGUAN HEATMOVING ELECTRONIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/724,297

(22) Filed: Apr. 19, 2022

(65) Prior Publication Data

US 2023/0207234 A1 Jun. 29, 2023

(30) Foreign Application Priority Data

Dec. 27, 2021 (CN) ..... 202111611879.X

(51) Int. Cl.
*H01H 13/705* (2006.01)
*H01H 13/14* (2006.01)

(52) U.S. Cl.
CPC ..... *H01H 13/705* (2013.01); *H01H 13/14* (2013.01)

(58) Field of Classification Search
CPC ..... G06F 3/00; G06F 3/02; H03K 17/975; H03K 17/9622; H03K 17/98; H03K 2217/96077; H01H 2223/00; H01H 2223/002; H01H 2223/01; H01H 2223/03; H01H 2223/032; H01H 2223/038; H01H 2223/042; H01H 2223/044; H01H 2233/00; H01H 2233/002; H01H 2233/004; H01H 2233/006; H01H 2233/008; H01H 2233/01; H01H 2233/05; H01H 2233/07; H01H 2235/006; H01H 2235/02; H01H 13/00; H01H 13/04; H01H 13/14; H01H 13/26; H01H 13/28; H01H 13/50; H01H 13/52; H01H 13/70; H01H 13/705; H01H 13/85; H01H 2205/00; H01H 2215/00; H01H 2215/028; H01H 2221/00; H01H 2221/008; H01H 1/00; H01H 1/12; H01H 1/14; H01H 3/00; H01H 3/12; H01H 3/32; H01H 5/00
See application file for complete search history.

(56) References Cited

U.S. PATENT DOCUMENTS 10,102,987 B1 * 10/2018 Alexander ..... H01H 13/78

* cited by examiner

*Primary Examiner* — Anthony R Jimenez
(74) *Attorney, Agent, or Firm* — Bochner PLLC; Andrew D. Bochner

(57) ABSTRACT

A shaft and a keyboard are provided. The shaft includes a shaft casing having a shaft cavity running theretrough, a shaft core and a first elastic part. A downward surface of the shaft casing is provided with a groove, a partition board is provided between the groove and the shaft cavity, and the partition board is provided with a channel in a direction of the shaft cavity. The shaft core slidably penetrates through the shaft cavity, a sliding protrusion corresponding to the channel in position is provided on a side surface of the shaft core, and the sliding protrusion has a first inclined surface and a second inclined surface which are arranged back to back; the first elastic part is mounted in the groove, and has a fixed end detachably connected with the shaft casing and an abutting end capable of abutting against the first inclined surface at the channel.

12 Claims, 9 Drawing Sheets

SHAFT AND KEYBOARD

CROSS-REFERENCE TO RELATED APPLICATION

The present disclosure claims the priority to the Chinese patent application with the filing No. 202111611879X, filed on Dec. 27, 2021 with Chinese Patent Office, and entitled "SHAFT AND KEYBOARD", the contents of which are incorporated by reference herein in entirety.

TECHNICAL FIELD

The present application relates to the technical field of keyboards, and particularly to a shaft and a keyboard.

BACKGROUND ART

With popularization and development of computers, keyboards have become important input devices. A pressing feel of each key switch of a conventional mechanical feel keyboard is determined by a switch module, a pressing feel of the switch module is fixed during production and unable to be regulated, and when the keyboard is required to achieve different pressing feels, different switch modules are necessary to be replaced, which has a high cost and is not conducive to meeting pressing feel requirements of different users.

SUMMARY

The present application provides a shaft and a keyboard which are used to solve a problem that in a mechanical feel keyboard in the prior art, different pressing feels are achieved only by replacing different switch modules, which has a high cost and is not conducive to meeting pressing feel requirements of different users.

In order to solve the above-mentioned problem, the present application provides a shaft, including:

a shaft casing having a shaft cavity running therethrough, a groove being formed in a downward surface of the shaft casing, the groove being located on one side of the shaft cavity, a partition board being provided between the groove and the shaft cavity, and the partition board being provided with a channel in a direction of the shaft cavity;

a shaft core slidably penetrating through the shaft cavity, a sliding protrusion corresponding to the channel in position being provided on a side surface of the shaft core, and the sliding protrusion having a first inclined surface and a second inclined surface which are arranged back to back; and a first elastic part mounted in the groove, the first elastic part having a fixed end detachably connected with the shaft casing and an abutting end capable of abutting against the first inclined surface at the channel, wherein when the shaft core slides downwards, the abutting end can slide along the first inclined surface and strike the side surface of the shaft core or a side wall surface of the groove, and when the shaft core slides upwards, the abutting end can slide along the second inclined surface onto the first inclined surface.

In a possible embodiment, the sliding protrusion penetrates through the channel and is partially located in the groove, a surface of the partition board facing the groove is provided with a limiting protrusion, and a surface of the limiting protrusion facing the abutting end serves as a guide surface;

when the shaft core slides downwards, the abutting end can slide along the first inclined surface and the guide surface simultaneously, such that the abutting end can move in a direction away from the shaft core.

In a possible embodiment, a distance between the partition board and an edge of the guide surface away from the partition board is a first distance, a distance between a top of the sliding protrusion and the partition board is a second distance, and the first distance is greater than the second distance.

In a possible embodiment, a plurality of strip-shaped protrusions are provided on a side wall surface of the shaft cavity at intervals in a circumferential direction of the shaft cavity, the strip-shaped protrusions are arranged in the sliding direction of the shaft core, and an oil injection gap is formed by joint enclosing of an inner wall surface of the shaft cavity, the shaft core and two adjacent strip-shaped protrusions.

The present application further provides a keyboard including the shafts according to any one of the above-mentioned embodiments.

In a possible embodiment, the keyboard further includes:

a flat board provided with a plurality of shaft holes, each shaft casing being located in the corresponding shaft hole;

a circuit board attached to a downward surface of the flat board, the circuit board being provided with insertion holes each corresponding to the corresponding shaft cavity in position, and on a downward surface of the circuit board, two opposite sides of each insertion hole are provided with a light-emitting element and a light-receiving element respectively, wherein an end of the shaft core close to the circuit board serves as an insertion portion, and the insertion portion is configured to slidably penetrate through the insertion hole, so as to or not to be located between the light-emitting element and the light-receiving element for blockage;

a plurality of keycaps, each of which is connected with an end of the corresponding shaft core away from the circuit board; and a plurality of second elastic parts, each second elastic part abutting between the corresponding shaft core and the circuit board, so as to drive the shaft core to move in a direction away from the circuit board.

In a possible embodiment, a surface of the shaft core facing the circuit board is provided with an annular groove, the annular groove is provided surrounding the exterior of the insertion portion, and an end of the second elastic part away from the circuit board abuts in the annular groove.

In a possible embodiment, the keycap is integrally formed with the shaft core, a side wall of the annular groove close to the shaft casing is provided with a through groove, an elastic arm is provided extending on an inner wall surface of the through groove in the sliding direction of the shaft core, and a snapping protrusion is provided extending towards the shaft casing on a surface of the elastic arm close to the shaft casing;

the side wall surface of the shaft cavity is provided with a sliding groove corresponding to the snapping protrusion in position;

when the shaft core is inserted into the shaft cavity from a side of the shaft casing away from the circuit board, the snapping protrusion can be snapped into the sliding groove and slide in the sliding groove.

In a possible embodiment, a plurality of abutting protrusions are provided on the surface of the shaft core facing the circuit board, the plurality of abutting protrusions are provided outside the annular groove at intervals in a circumferential direction of the shaft core, and the plurality of abutting protrusions can abut against the circuit board.

In a possible embodiment, a light-transmitting hole is formed in the insertion portion in a radial direction of the shaft core, and the insertion portion can be located between the light-emitting element and the light-receiving element for blockage;

when the insertion portion slides downwards until the light-transmitting hole is located between the light-emitting element and the light-receiving element, light generated by the light-emitting element can pass through the light-transmitting hole to the light-receiving element.

In a possible embodiment, a first light-transmitting groove is formed in the downward surface of the shaft casing, the first light-transmitting groove is located on a side of the shaft cavity away from the groove, a second light-transmitting groove corresponding to the first light-transmitting groove in position is formed in an upward surface of the shaft casing, and a light-transmitting board is formed between the first light-transmitting groove and the second light-transmitting groove;

the circuit board is provided with a plurality of lamp beads, a position of each lamp bead corresponds to a position of the first light-transmitting groove, and light emitted by the lamp bead can be transmitted through the light-transmitting board to the keycap.

In a possible embodiment, the shaft casing is integrally formed with the flat board.

The present application has the following beneficial effects. The present application proposes the shaft and the keyboard; in use of the shaft, when the shaft core slides downwards in the shaft casing, the abutting end of the first elastic part can slide along the first inclined surface; since the first elastic part has an elasticity, the abutting end can strike the side surface of the shaft core or the side wall surface of the groove when the abutting end rebounds and returns to an original position, thereby generating a crisp sound. When the shaft core returns to an original position, that is, when the shaft core slides upwards, the abutting end can slide to the first inclined surface along the second inclined surface, thereby recovering an initial state. When the shaft core slides downwards, in the process that the abutting end slides along the first inclined surface, an acting force applied by the abutting end to the shaft core is increased gradually with an increase of a deformation degree of the first elastic part, and when the abutting end generates the sound, a pressing resistance of the shaft core is reduced, such that the user can have a mechanical feel when pressing the shaft core. Since the fixed end of the first elastic part is detachably connected with the groove, the user can adjust the resistance generated by pressing the shaft and the sound generated during the striking of the abutting end by replacing the first elastic parts with different specifications and elastic forces, so as to meet a requirement that the user experiences different pressing feels.

BRIEF DESCRIPTION OF DRAWINGS

To describe the technical solutions in the embodiments of the present application more clearly, the following briefly describes the accompanying drawings required in the embodiments. It should be understood that the following accompanying drawings show merely some embodiments of the present application and therefore should not be considered as limiting the scope, and a person of ordinary skill in the art may still derive other related drawings from these accompanying drawings without paying creative efforts.

MAIN ELEMENT REFERENCE NUMERALS

Figure 1:
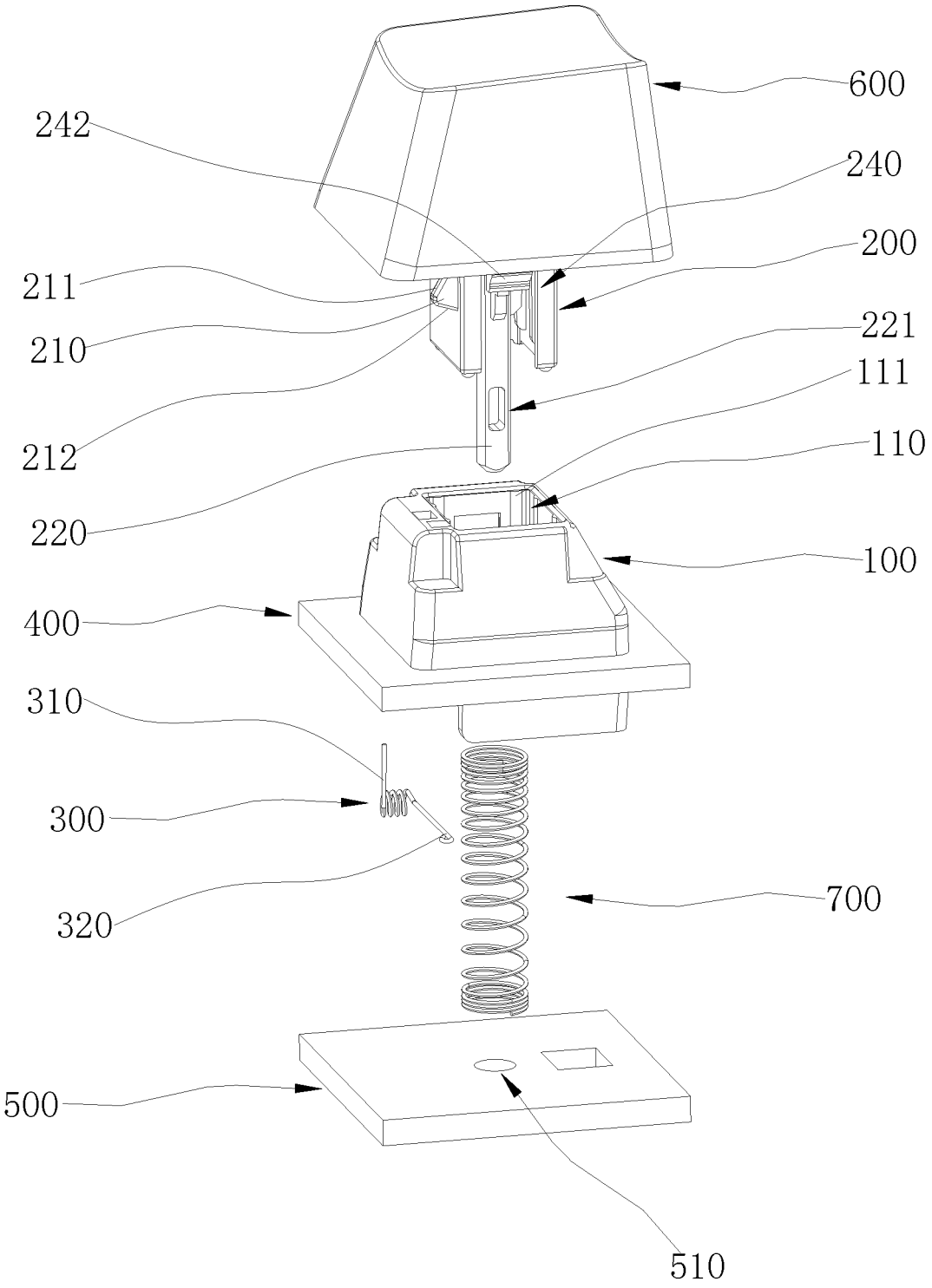
FIG. 1 shows a schematic exploded structural diagram of a part of a keyboard according to an embodiment of the present disclosure.

100—shaft casing; 110—shaft cavity; 111—strip-shaped protrusion; 112—oil injection gap; 113—sliding groove; 120—groove; 130—partition board; 131—channel; 132—limiting protrusion; 133—guide surface; 134—first distance; 140—first light-transmitting groove; 141—light-transmitting board; 150—second light-transmitting groove; 200—shaft core; 210—sliding protrusion; 211—first inclined surface; 212—second inclined surface; 213—second distance; 220—insertion portion; 221—light-transmitting hole; 230—annular groove; 240—through groove; 241—elastic arm; 242—snapped protrusion; 250—abutting protrusion; 300—first elastic part; 310—fixed end; 320—abutting end; 400—flat board; 500—circuit board; 510—insertion hole; 520—light-emitting element; 530—light-receiving element; 540—lamp bead; 600—keycap; 700—second elastic part.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

In descriptions of the present application, it should be understood that, directions or positional relationships indicated by terms "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial", "circumferential" etc. are based on orientations or positional relationships shown in the accompanying drawings, and they are used only for describing the present application and for simplifying description, but do not indicate or imply that an indicated device or element must have a specific orientation or be constructed and operated in a specific orientation. Therefore, it cannot be understood as a limitation on the present application.

In addition, the terms such as "first" and "second" are used herein for purposes of description and are not intended to indicate or imply importance in relativity or to imply the number of indicated technical features. Thus, the feature defined with "first" and "second" may include one or more of this feature explicitly or implicitly. In the description of the present application, "a plurality of" means two or more, unless it is defined otherwise explicitly and specifically.

In the present application, unless explicitly specified or limited otherwise, the terms "mounted", "connected", "coupled", and "fixed" and the like should be understood broadly, for example, it may be fixed connection, detachable connection, or integral connection; may also be mechanical or electrical connection; may also be direct connection or indirect connection via intermediate medium; may also be communication between two elements or an interaction relationship of two elements. The specific meaning of the above terms in the present application can be understood by those skilled in the art according to specific situations.

In the present application, unless explicitly specified or limited otherwise, a first feature being "on" or "below" a second feature may refer to that the first feature is in direct contact with the second feature, or that the first feature and the second feature are in indirect contact via an intermediate medium. Furthermore, a first feature being "on", "above", or "on top of" a second feature may refer to that the first feature is right or obliquely "on", "above" or "on top of" the second feature, or just means that the first feature is at a horizontal height higher than that of the second feature. A first feature being "below", "under", or "on bottom of" a second feature may refer to that the first feature is right or obliquely "below", "under", or "on bottom of" the second feature, or just means that the first feature is at a horizontal height lower than that of the second feature.

First Embodiment

Referring to FIGS. 1, 2, 3 and 5, the present embodiment provides a shaft applied to a keyboard, and the shaft includes a shaft casing 100, a shaft core 200 and a first elastic part 300. The shaft casing 100 has a shaft cavity 110 running therethrough, a downward surface of the shaft casing 100 is provided with a groove 120, the groove 120 is located on one side of the shaft cavity 110, a partition board 130 is provided between the groove and the shaft cavity 110, and the partition board 130 is provided with a channel 131 in a direction of the shaft cavity 110. The shaft core 200 slidably penetrates through the shaft cavity 110, a sliding protrusion 210 corresponding to the channel 131 in position is provided on a side surface of the shaft core 200, and the sliding protrusion 210 has a first inclined surface 211 and a second inclined surface 212 which are arranged back to back. The first elastic part 300 is mounted in the groove 120, and the fixed end 310 of the first elastic part 300 is detachably connected with the shaft casing 100 and an abutting end 320 of the first elastic part 300 is capable of abutting against the first inclined surface 211 at the channel 131. When the shaft core 200 slides downwards, the abutting end 320 can slide along the first inclined surface 211 and strike the side surface of the shaft core 200 or a side wall surface of the groove 120, and when the shaft core 200 slides upwards, the abutting end 320 can slide along the second inclined surface 212 to the first inclined surface 211.

In use of the shaft according to the embodiment of the present application, when the shaft core 200 slides downwards in the shaft casing 100, the abutting end 320 of the first elastic part 300 can slide along the first inclined surface 211; since the first elastic part 300 has an elasticity, the abutting end 320 can strike the side surface of the shaft core 200 or the side wall surface of the groove 120 when rebounding and returning to an original position, thereby generating a crisp sound. When the shaft core 200 returns to an original position, that is, when the shaft core 200 slides upwards, the abutting end 320 can slide to the first inclined surface 211 along the second inclined surface 212, thereby recovering an initial state. When the shaft core 200 slides downwards, in the process that the abutting end 320 slides along the first inclined surface 211, an acting force applied by the abutting end 320 to the shaft core 200 is increased gradually with an increase of a deformation degree of the first elastic part 300, until the abutting end 320 generates the sound, at which time a pressing resistance of the shaft core 200 is reduced, such that a user can have a mechanical feel when pressing the shaft core 200. Since the fixed end 310 of the first elastic part 300 is detachably connected with the groove 120, the user can adjust the resistance generated by pressing the shaft and the sound generated during the striking of the abutting end 320 by replacing the first elastic parts 300 with different specifications and elastic forces, so as to meet a requirement that the user experiences different pressing feels.

Here, in order to facilitate the upward sliding of the shaft core 200 in the shaft cavity 110, a first included angle between the first inclined surface 211 and the sliding direction of the shaft core 200 may be set to be greater than a second included angle between the second inclined surface 212 and the sliding direction of the shaft core 200, such that an inclination degree of the second inclined surface 212 is less than an inclination degree of the first inclined surface 211, and then, a resistance of the abutting end 320 to the shaft core 200 when the shaft core 200 slides upwards is made to be less than a resistance of the abutting end 320 to the shaft core 200 when the shaft core 200 slides downwards, thereby facilitating the upward sliding of the shaft core 200 to return to the original position.

Second Embodiment

Figure 2:
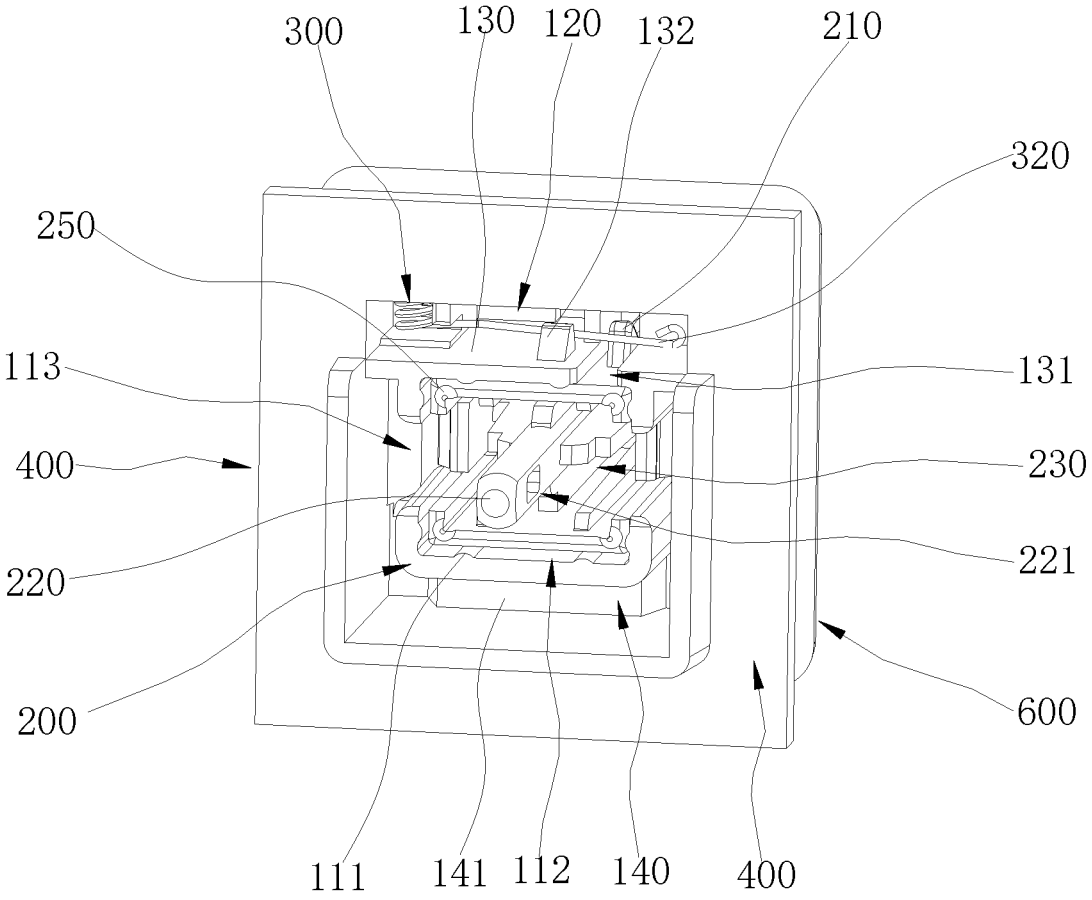
FIG. 2 shows a schematic structural diagram of a shaft according to an embodiment of the present disclosure from one viewing angle.

As shown in FIG. 2, the present embodiment proposes an arrangement of the shaft casing 100 on the basis of the first embodiment. The sliding protrusion 210 penetrates through the channel 131 and is partially located in the groove 120, a limiting protrusion 132 is provided on a surface of the partition board 130 facing the groove 120, and a surface of the limiting protrusion 132 facing the abutting end 320 serves as a guide surface 133. When the shaft core 200 slides downwards, the abutting end 320 can slide along the first inclined surface 211 and the guide surface 133 simultaneously, such that the abutting end 320 can move in a direction away from the shaft core 200.

Specifically, in use, when the shaft core 200 slides downwards in the shaft casing 100, the abutting end 320 of the first elastic part 300 can slide along the first inclined surface 211 and the guide surface 133 of the limiting protrusion 132 simultaneously; since the guide surface 133 and the first inclined surface 211 are located at two opposite sides of the abutting end 320 respectively, the abutting end 320 can be better guided to slide in a direction away from the shaft core 200, thus increasing the force with which the abutting end 320 strikes the side surface of the shaft core 200 or the side wall surface of the groove 120, increasing volume of the sound generated during the striking, and improving user experiences.

Figure 3:
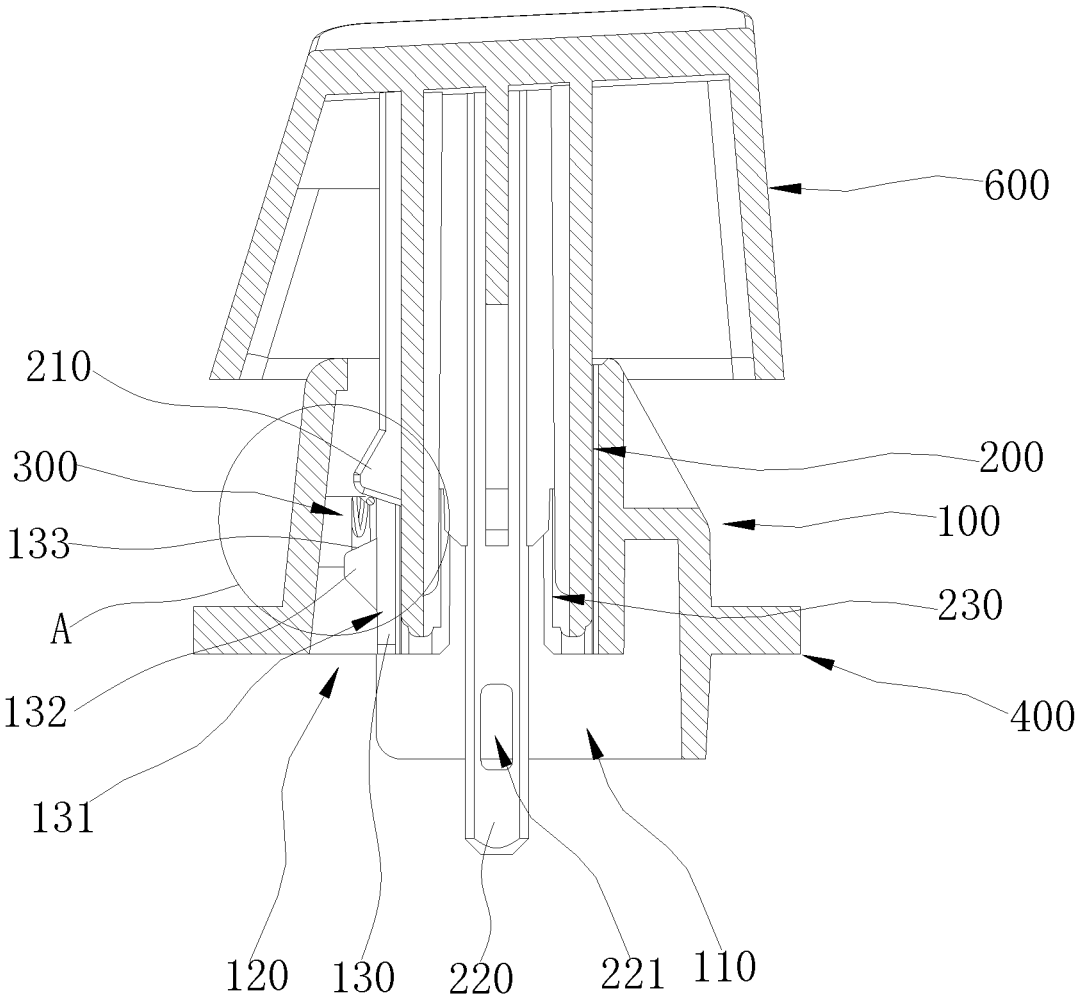
FIG. 3 shows a schematic sectional structural diagram of the shaft according to the embodiment of the present disclosure when a shaft core is not pressed.
Figure 4:
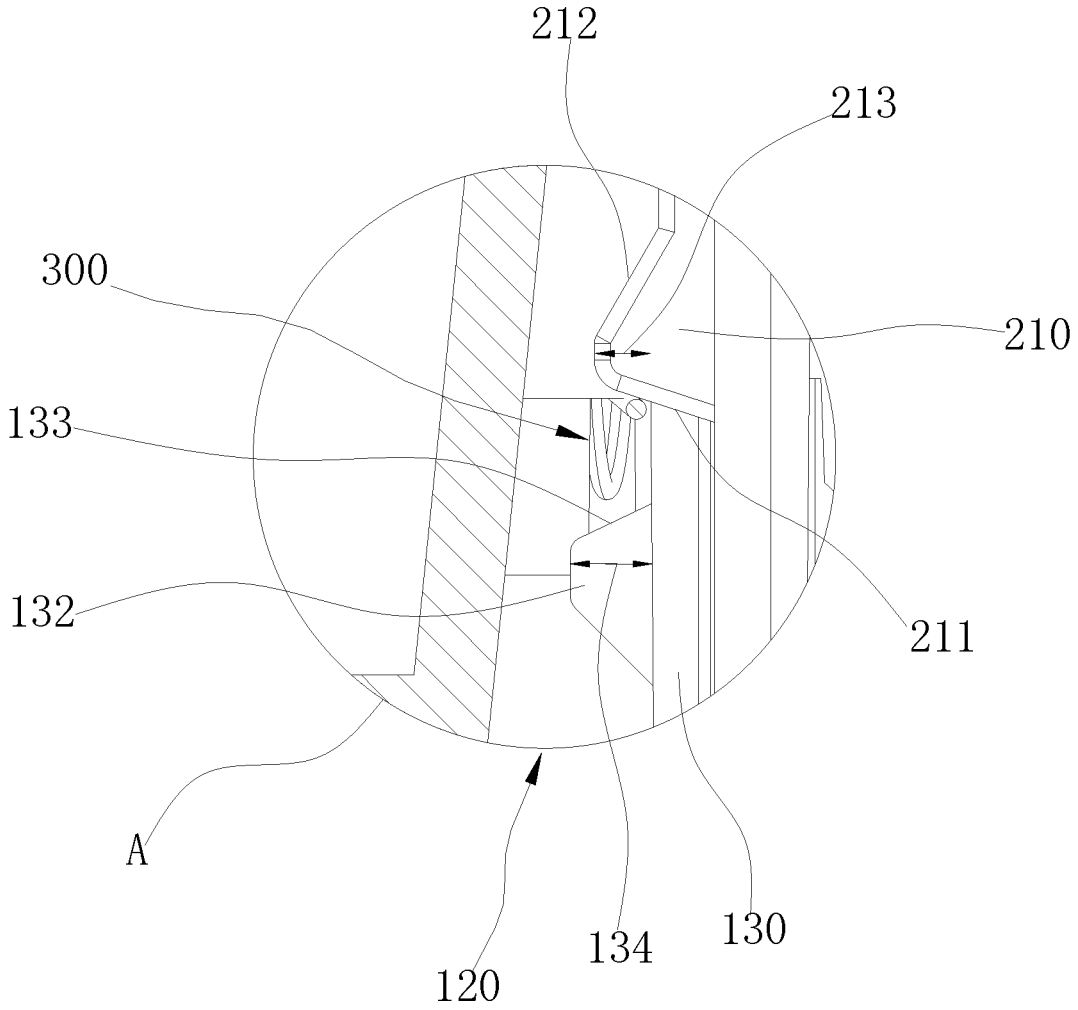
FIG. 4 shows a partially enlarged schematic structural diagram at A in FIG. 3.
Figure 5:
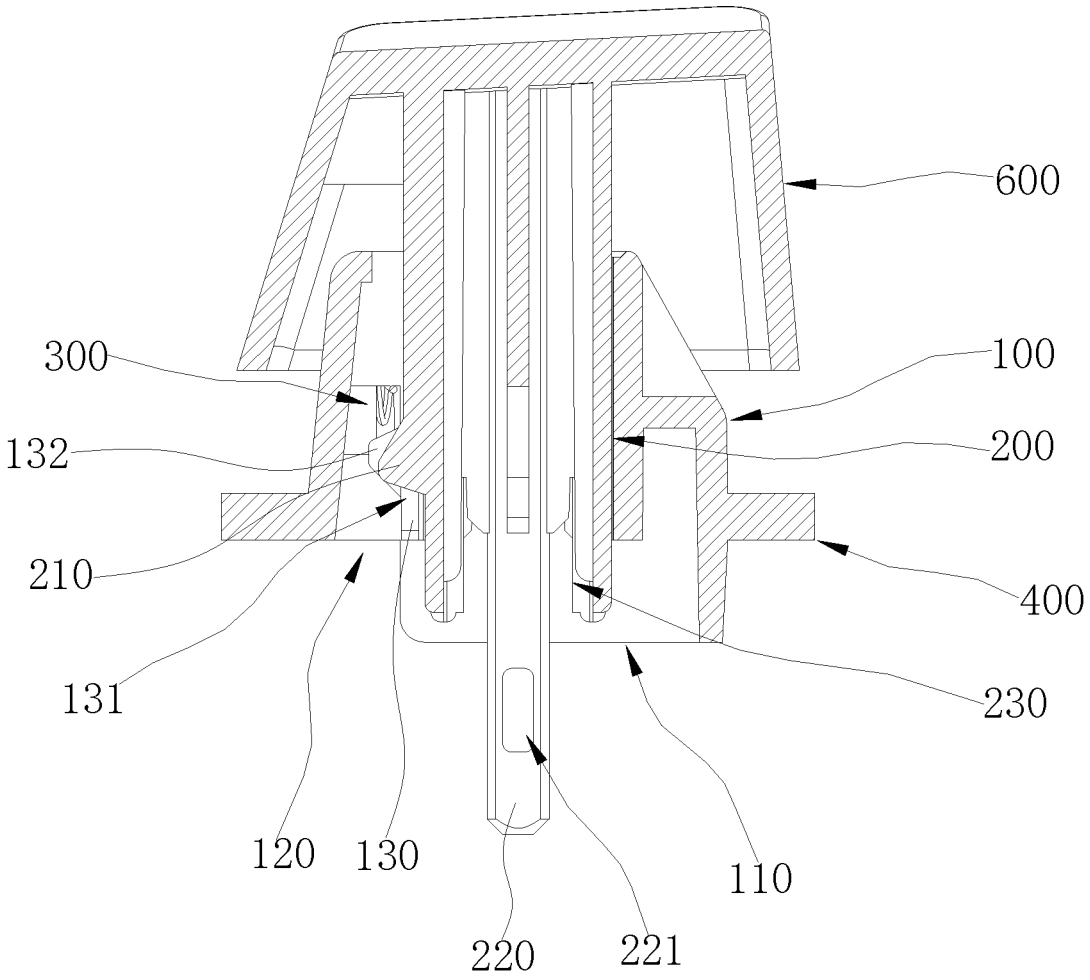
FIG. 5 shows a schematic sectional structural diagram of the shaft according to the embodiment of the present disclosure when the shaft core is pressed.

As shown in FIGS. 3 and 4, in the above-mentioned embodiment, optionally, a distance between an edge of the guide surface 133 away from the partition board 130 and the partition board 130 is a first distance 134, and a distance between a top of the sliding protrusion 210 and the partition board 130 is a second distance 213, and the first distance 134 is greater than the second distance 213.

Specifically, since the first distance 134 is greater than the second distance 213, when the shaft core 200 slides downwards in the shaft casing 100 and the abutting end 320 slides from the first inclined surface 211 to the second inclined surface 212, the abutting end 320 can always abut against the guide surface 133, and the guide surface 133 can assist the abutting end 320 in sliding to the second inclined surface 212, thereby avoiding that since the abutting end 320 slides to a top end of the limiting protrusion 132 along the guide surface 133, the abutting end 320 may not slide to the second inclined surface 212 along the first inclined surface 211 and may not normally return to an original position.

Figure 8:
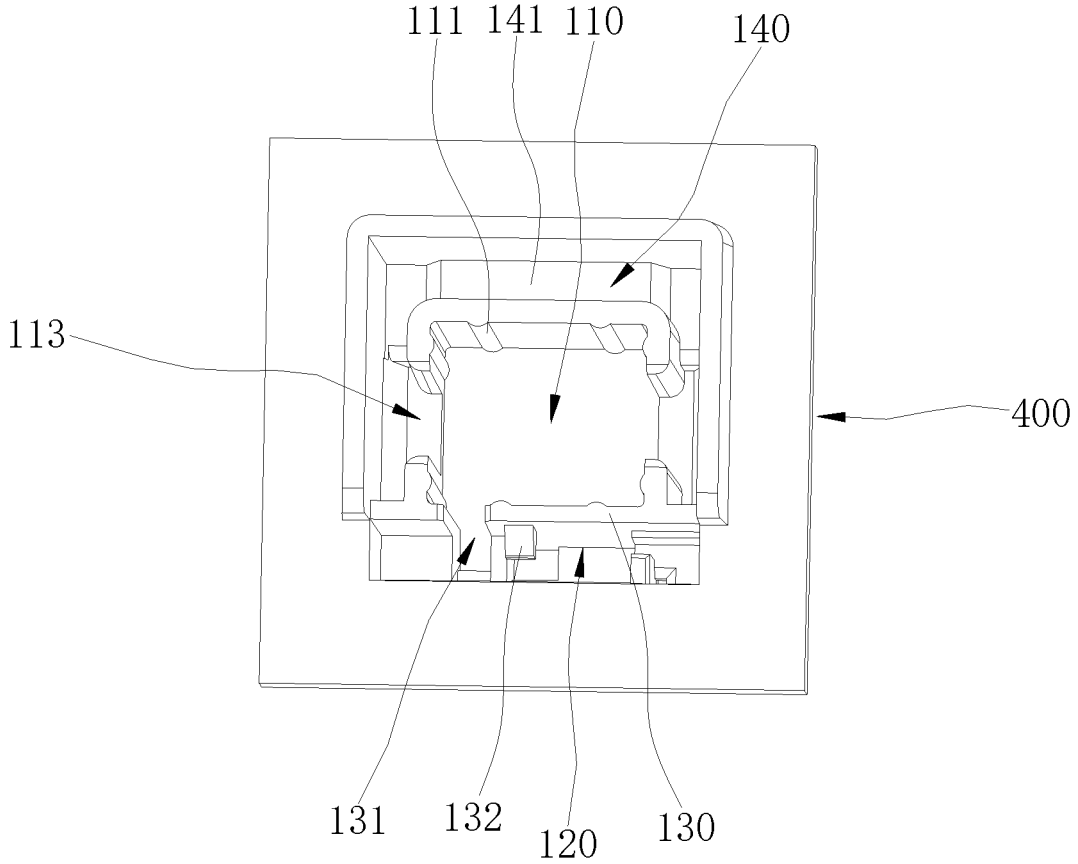
FIG. 8 shows a schematic structural diagram of a shaft casing of the shaft according to the embodiment of the present disclosure from one viewing angle.
Figure 9:
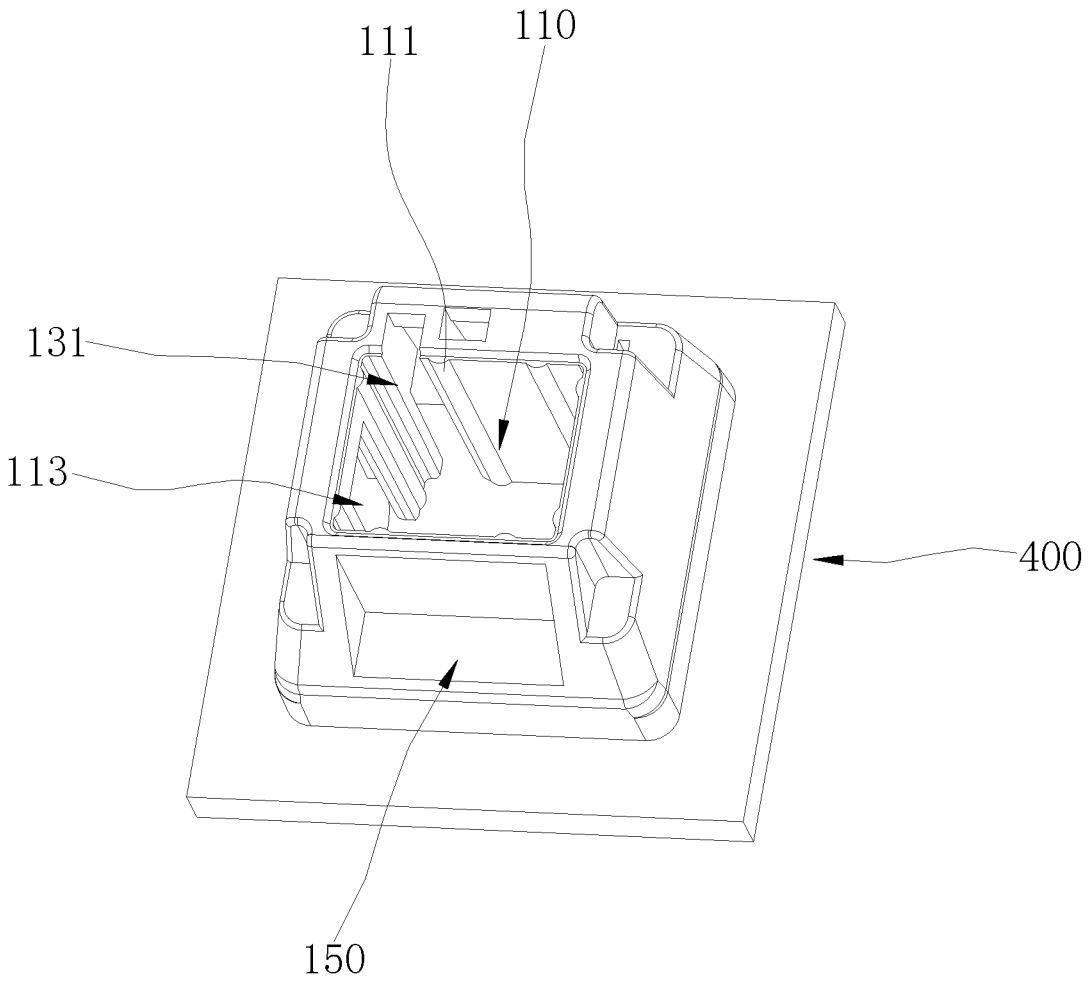
FIG. 9 shows a schematic structural diagram of the shaft casing of the shaft according to the embodiment of the present disclosure from another viewing angle.

As shown in FIGS. 2, 8 and 9, in the above-mentioned embodiment, optionally, a plurality of strip-shaped protrusions 111 are provided on a side wall surface of the shaft cavity 110 at intervals in a circumferential direction of the shaft cavity 110, the strip-shaped protrusions 111 are arranged in the sliding direction of the shaft core 200, and an oil injection gap 112 is formed by joint enclosing of an inner wall surface of the shaft cavity 110, the shaft core 200 and two adjacent strip-shaped protrusions 111.

Specifically, the plurality of strip-shaped protrusions 111 are provided on the side wall surface of the shaft cavity 110 at intervals in the circumferential direction of the shaft cavity 110, thereby reducing a contact area between the shaft core 200 and the shaft casing 100; and the plurality of strip-shaped protrusions 111 are located in the circumferential direction of the shaft core 200, such that a stress of the shaft core 200 is balanced, and a sliding resistance of the shaft core 200 can be reduced. Meanwhile, the oil injection gap 112 is formed by joint enclosing of the inner wall surface of the shaft cavity 110, the shaft core 200 and two adjacent strip-shaped protrusions 111, and the oil injection gap 112 forms a space capable of accommodating lubricating oil, enabling convenient injection of the lubricating oil. Meanwhile, due to the arrangement of the strip-shaped protrusions 111, a certain distance exists between the shaft casing 100 and the shaft core 200, thereby avoiding a problem that the lubricating oil contacts the shaft core 200 and the shaft casing 100 in a large area due to an excessively short distance between the shaft casing 100 and the shaft core 200, resulting in an increased sliding resistance of the shaft core 200.

In the above, the sliding protrusion 210 may be set to have an arc-shaped cross section, and the arc-shaped sliding protrusion 210 linearly contacts the shaft core 200, which can reduce the contact area between the sliding protrusion 210 and the shaft core 200, thereby reducing the sliding resistance of the shaft core 200.

Third Embodiment

Another embodiment of the present application provides a keyboard, including the shaft(s) according to any one of the above-mentioned embodiments.

The keyboard according to the embodiment of the present application has the shafts according to any one of the above-mentioned embodiments, and therefore has all the beneficial effects of the shaft according to any one of the above-mentioned embodiments, which are not repeated herein.

The keyboard may be a membrane keyboard, a mechanical keyboard, an optical axis keyboard, or the like.

Figure 6:
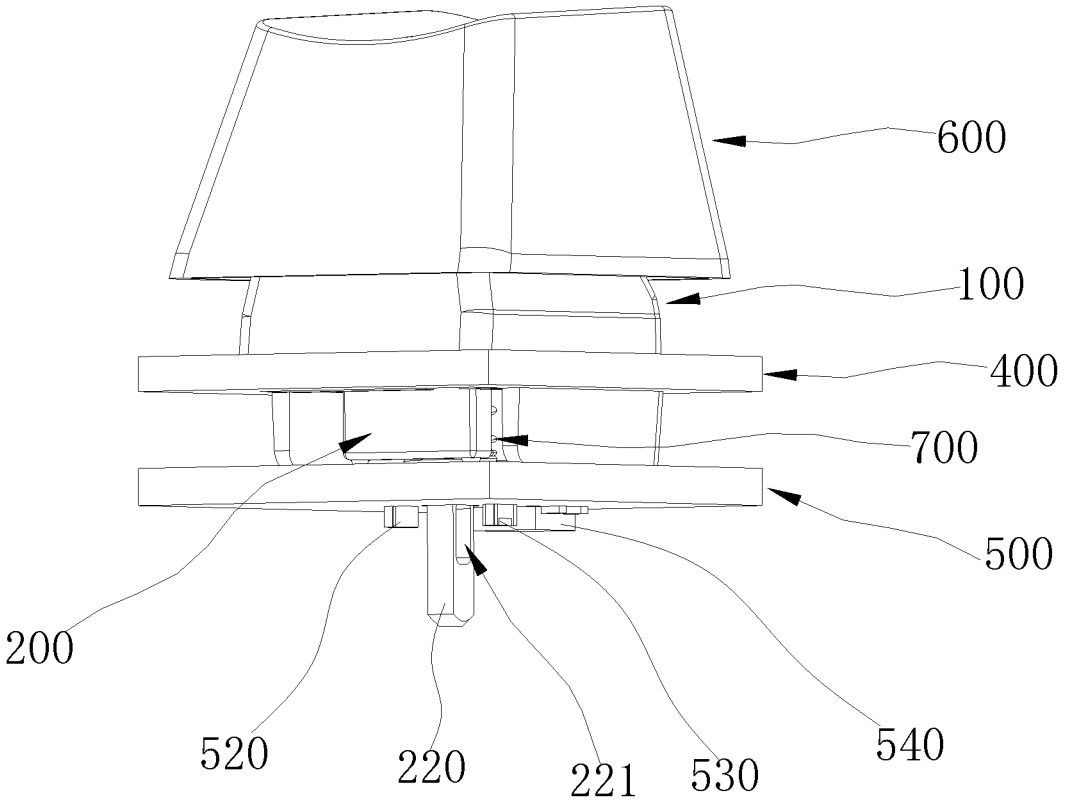
FIG. 6 shows a schematic structural diagram of the shaft according to the embodiment of the present disclosure when the shaft core is pressed.

As shown in FIGS. 1 and 6, in the above-mentioned embodiment, optionally, the keyboard further includes a flat board 400, a circuit board 500, a plurality of keycaps 600, and a plurality of second elastic parts 700. The flat board 400 is provided with a plurality of shaft holes, and the shaft casing 100 is located in the shaft hole. The circuit board 500 is attached to a downward surface of the flat board 400, the circuit board 500 is provided with insertion holes 510 each corresponding to the corresponding shaft cavity 110 in position, and on a downward surface of the circuit board 500, two opposite sides of each insertion hole 510 are provide with a light-emitting element 520 and a light-receiving element 530 respectively. An end of the shaft core 200 close to the circuit board 500 serves as an insertion portion 220, and the insertion portion 220 slidably penetrates through the corresponding insertion hole 510, so as to or not to be located between the light-emitting element 520 and the light-receiving element 530 for blockage. The keycap 600 is connected with an end of the shaft core 200 away from the circuit board 500. Each second elastic part 700 abuts between the corresponding shaft core 200 and the circuit board 500, so as to drive the shaft core 200 to move in a direction away from the circuit board 500.

Specifically, when the keyboard is in use, the user presses the keycap 600 at a top of the shaft core 200 to drive the shaft core 200 to slide downwards, the insertion portion 220 at a lower end of the shaft core 200 can penetrate through the insertion hole 510 in the circuit board 500, and the insertion portion 220 can be to not be located between the light-emitting element 520 and the light-receiving element 530 of the circuit board 500 for blockage, such that a light path between the light-emitting element 520 and the light-receiving element 530 is conducted or not conducted, thereby triggering an electrical function of the circuit board 500. When the user releases the keycap 600, the second elastic part 700 between the shaft core 200 and the circuit board 500 provides an elastic supporting force to make the shaft core 200 slide in a direction away from the circuit board 500, so as to drive the shaft core 200 to return to the original position; at this point, the insertion portion 220 can be or not be located between the light-emitting element 520 and the light-receiving element 530 of the circuit board 500 for blockage, such that the light path between the light-emitting element 520 and the light-receiving element 530 is not conducted or conducted; in the process of the shaft core 200 returning to the original position, the abutting end 320 of the first elastic part 300 can slide back to the first inclined surface 211 along the second inclined surface 212.

In the above, the light-emitting element 520 may be an infrared light-emitting tube, and the light-receiving element 530 may be an infrared receiving tube.

In the above, when the keyboard is a membrane keyboard, the circuit board 500 may be replaced by a conductive membrane, the conductive membrane includes an upper circuit layer, an adhesive interlayer, and a lower circuit layer which are sequentially arranged from top to bottom, a contact of the upper circuit layer and a contact of the lower circuit layer may be connected with each other through a through hole in the adhesive interlayer, the second elastic part 700 may be replaced by a rubber dome, and the shaft core 200 and the rubber dome are adapted to each other. In use of the membrane keyboard, the shaft core 200 is made to slide downwards by pressing the keycap 600, and when the shaft core 200 abuts against the rubber dome, the rubber dome is elastically deformed, such that the rubber dome abuts against the upper circuit layer, and the contact of the upper circuit layer is electrically connected with the contact of the lower circuit layer, thereby triggering an electrical function of the conductive membrane.

Fourth Embodiment

Figure 7:
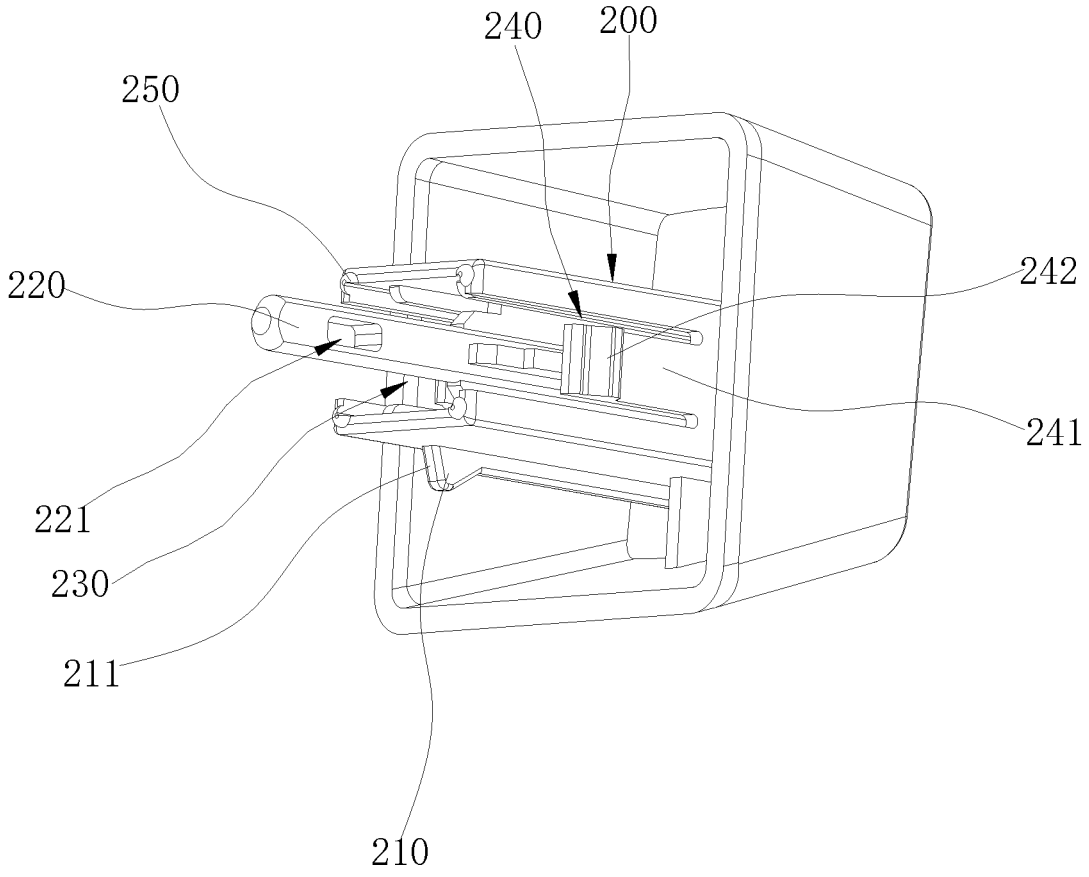
FIG. 7 shows a schematic structural diagram of the shaft core of the shaft according to the embodiment of the present disclosure.

As shown in FIGS. 1, 2 and 7, the present embodiment proposes an arrangement of the shaft core 200 on the basis of the first to third embodiments. An annular groove 230 is formed in a surface of the shaft core 200 facing the circuit board 500, the annular groove 230 is provided surrounding the exterior of the insertion portion 220, and an end of the second elastic part 700 away from the circuit board 500 abuts in the annular groove 230.

Specifically, by providing the annular groove 230 on the surface of the shaft core 200 facing the circuit board 500, the second elastic part 700 is made to abut in the annular groove 230, such that the second elastic part 700 can be limited in the annular groove 230. Since the annular groove 230 is provided surrounding the exterior of the insertion portion 220, the second elastic part 700 can slide in an axial direction of the insertion portion 220, thus preventing the second elastic part 700 from being bent in a radial direction of the second elastic part 700, and guaranteeing a stability when the second elastic part 700 is deformed.

As shown in FIG. 7, in the above-mentioned embodiment, optionally, the keycap 600 and the shaft core 200 are integrally formed, a through groove 240 is formed in a side wall of the annular groove 230 close to the shaft casing 100, an elastic arm 241 is provided extending on an inner wall surface of the through groove 240 in the sliding direction of the shaft core 200, and a snapping protrusion 242 is provided extending towards the shaft casing 100 on a surface of the elastic arm 241 close to the shaft casing 100. A sliding groove 113 corresponding to the snapping protrusion 242 in position is formed in the side wall surface of the shaft cavity 110. When the shaft core 200 is inserted into the shaft cavity 110 from a side of the shaft casing 100 away from the circuit board 500, the snapping protrusion 242 can be snapped into the sliding groove 113 and slide in the sliding groove 113.

Specifically, integral formation of the keycap 600 and the shaft core 200 can decrease the number of parts, reduce steps of mounting between the keycap 600 and the shaft core 200, and lower production and processing cost. The through groove 240 is formed in the side wall of the shaft core 200, the elastic arm 241 is provided extending on the inner wall surface of the through groove 240 in the sliding direction of the shaft core 200, and the snapping protrusion 242 is provided extending towards the shaft casing 100 on the surface of the elastic arm 241 close to the shaft casing 100, such that when the shaft core 200 is mounted into the shaft cavity 110 from the side of the shaft casing 100 away from the circuit board 500, the elastic arm 241 can be deformed elastically, and therefore, the snapping protrusion 242 is displaced towards the shaft core 200 and the snapping protrusion 242 can be snapped into the sliding groove 113. When the shaft core 200 slides downwards in the shaft cavity 110, the snapping protrusion 242 can slide along the sliding groove 113.

In the above, in order to balance the sliding stress of the shaft core 200, two opposite sides of the shaft core 200 may be provided with the through grooves 240, the elastic arms 241 and the snapping protrusions 242 respectively, and the sliding grooves 113 are correspondingly provided in the shaft casing 100.

As shown in FIGS. 6 and 7, in the above-mentioned embodiment, optionally, a plurality of abutting protrusions 250 are provided on the surface of the shaft core 200 facing the circuit board 500, the plural abutting protrusions 250 are provided outside the annular groove 230 at intervals in a circumferential direction of the shaft core 200, and the plural abutting protrusions 250 can abut against the circuit board 500.

Specifically, the plurality of abutting protrusions 250 are provided on the surface of the shaft core 200 facing the circuit board 500, such that a manufacturer can adjust a maximum sliding stroke of the shaft core 200 by changing a height of the abutting protrusion 250 relative to the shaft core 200. Therefore, the arrangement of the abutting protrusion 250 can allow the manufacturer to conveniently change a mold, so as to adjust the maximum sliding stroke of the shaft core 200 conveniently.

As shown in FIGS. 1 and 6, in the above-mentioned embodiment, optionally, a light-transmitting hole 221 is formed in the insertion portion 220 in a radial direction of the shaft core 200, and the insertion portion 220 can be located between the light-emitting element 520 and the light-receiving element 530 for blockage. When the insertion portion 220 slides downwards until the light-transmitting hole 221 is located between the light-emitting element 520 and the light-receiving element 530, light generated by the light-emitting element 520 can pass through the light-transmitting hole 221 to the light-receiving element 530.

Specifically, when the shaft core 200 does not slide downwards in the shaft casing 100, the insertion portion 220 penetrates through the insertion hole 510 and is located between the light-emitting element 520 and the light-receiving element 530 for blockage, such that the light path between the light-emitting element 520 and the light-receiving element 530 is not conducted, and the electrical function of the circuit board 500 is not triggered. When the shaft core 200 slides downwards in the shaft casing 100, the light-transmitting hole 221 in the insertion portion 220 is located between the light-emitting element 520 and the light-receiving element 530, such that the light path between the light-emitting element 520 and the light-receiving element 530 is conducted through the light-transmitting hole 221, thereby triggering the electrical function of the circuit board 500.

Fifth Embodiment

As shown in FIGS. 8 and 9, the present embodiment proposes an arrangement of the shaft casing 100 on the basis of the first to fourth embodiments. The downward surface of the shaft casing 100 is provided with a first light-transmitting groove 140, the first light-transmitting groove 140 is located on a side of the shaft cavity 110 away from the groove 120, an upward surface of the shaft casing 100 is provided with a second light-transmitting groove 150 corresponding to the first light-transmitting groove 140 in position, and a light-transmitting board 141 is formed between the first light-transmitting groove 140 and the second light-transmitting groove 150. The circuit board 500 is provided with a plurality of lamp beads 540, a position of each lamp bead 540 corresponds to a position of the corresponding first light-transmitting groove 140, and light emitted by the lamp bead 540 can be transmitted through the light-transmitting board 141 to the keycap 600.

Specifically, the downward surface of the shaft casing 100 is provided with the first light-transmitting groove 140, and the upward surface of the shaft casing 100 is provided with the second light-transmitting groove 150 corresponding to the first light-transmitting groove 140 in position, such that the light-transmitting board 141 is formed between the first light-transmitting groove 140 and the second light-transmitting groove 150. When the keyboard is in use, the light emitted by the lamp bead 540 on the circuit board 500 can reach the keycap 600 through the light-transmitting board 141, such that a character on the keycap 600 is more conspicuous, thus improving aesthetic property of the keyboard. Here, since the light-transmitting board 141 has a flat board 400 structure, a propagation direction of the light may not be changed greatly when the light passes through the light-transmitting board 141, such that the light is conveniently focused and radiated on the character on the keycap 600, thus increasing a utilization ratio of the light.

Here, the shaft casing 100 may be made of a transparent material, and the transparent shaft casing 100 may refract the light emitted by the lamp bead 540 to achieve a better lighting effect.

As shown in FIG. 1, in the above-mentioned embodiment, optionally, the shaft casing 100 and the flat board 400 are integrally formed.

Specifically, integral formation of the shaft casing 100 and the flat board 400 can omit a step of mounting the shaft casing 100 on the flat board 400, thereby better saving the production and processing cost, and facilitating wide use.

In the description of the present specification, reference throughout this specification to "an embodiment", "some embodiments", "example", "specific example" or "some examples" means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples. Furthermore, those skilled in the art may combine different embodiments or examples and features in different embodiments or examples described in the specification, without mutual contradictions.

Although embodiments of the present application have been shown and illustrated, it shall be understood that the above-mentioned embodiments are exemplary and not construed as limitations to the present application. Various changes, modifications, alternatives and variants within the scope of the present application may be made by those skilled in the art.

What is claimed is:

1. A shaft, comprising:

a shaft casing having a shaft cavity running therethrough, wherein a downward surface of the shaft casing is provided with a groove, the groove is located on one side of the shaft cavity, a partition board is provided between the groove and the shaft cavity, and the partition board is provided with a channel in a direction of the shaft cavity;

a shaft core configured for slidably penetrating through the shaft cavity, wherein a side surface of the shaft core is provided with a sliding protrusion corresponding to the channel, and the sliding protrusion has a first inclined surface and a second inclined surface which are arranged back to back; and a first elastic part mounted in the groove, wherein a fixed end of the first elastic part is detachably connected with the shaft casing, and an abutting end of the first elastic part abuts against the first inclined surface at the channel, wherein when the shaft core slides downwards, the abutting end slides along the first inclined surface and strikes the side surface of the shaft core or a side wall surface of the groove, and when the shaft core slides upwards, the abutting end slides along the second inclined surface to the first inclined surface.

2. The shaft according to claim 1, wherein a plurality of strip-shaped protrusions are provided on a side wall surface of the shaft cavity at intervals in a circumferential direction of the shaft cavity, the plurality of strip-shaped protrusions are arranged in a sliding direction of the shaft core, and an oil injection gap is formed by joint enclosing of an inner wall surface of the shaft cavity, the shaft core and two adjacent strip-shaped protrusions.

3. The shaft according to claim 1, wherein the sliding protrusion penetrates through the channel and is partially located in the groove, a limiting protrusion is provided on a surface of the partition board facing the groove, and a surface of the limiting protrusion facing the abutting end serves as a guide surface; and when the shaft core slides downwards, the abutting end slides along the first inclined surface and the guide surface simultaneously, such that the abutting end moves in a direction away from the shaft core.

4. The shaft according to claim 3, wherein a distance between an edge of the guide surface away from the partition board and the partition board is a first distance, a distance between a top of the sliding protrusion and the partition board is a second distance, and the first distance is greater than the second distance.

5. A keyboard, comprising a plurality of shafts, each of which is the shaft according to any one of claims 1 to 2.

6. The keyboard according to claim 5, further comprising:

a flat board provided with a plurality of shaft holes, wherein the shaft casing of each of the plurality of shafts is located in a corresponding shaft hole;

a circuit board attached to a downward surface of the flat board, wherein the circuit board is provided with insertion holes each corresponding to a corresponding shaft cavity, and on a downward surface of the circuit board, two opposite sides of each of the insertion holes are provided with a light-emitting element and a light-receiving element respectively, wherein an end of each of the shaft cores close to the circuit board serves as an insertion portion, and the insertion portion is configured to slidably penetrate through a corresponding insertion hole, so as to be or not to be located between the light-emitting element and the light-receiving element for blockage;

a plurality of keycaps, each of which is connected with an end of a corresponding shaft core away from the circuit board; and a plurality of second elastic parts, each of the plurality of second elastic parts abutting between a corresponding shaft core and the circuit board, so as to drive the shaft core to move in a direction away from the circuit board.

7. The keyboard according to claim 6, wherein a surface of each of the shaft cores facing the circuit board is provided with an annular groove, the annular groove is provided surrounding an exterior of a corresponding insertion portion, and an end of a corresponding second elastic part away from the circuit board abuts in the annular groove.

8. The keyboard according to claim 7, wherein the keycap is integrally formed with the corresponding shaft core, a side wall of the annular groove close to the shaft casing is provided with a through groove, an elastic arm is provided extending on an inner wall surface of the through groove in a sliding direction of the shaft core, and a snapping protrusion is provided extending towards the shaft casing on a surface of the elastic arm close to the shaft casing;

a side wall surface of the shaft cavity is provided with a sliding groove corresponding to the snapping protrusion in position; and when the shaft core is inserted into the shaft cavity from a side of the shaft casing away from the circuit board, the snapping protrusion is snapped into the sliding groove and slide in the sliding groove.

9. The keyboard according to claim 7, wherein a surface of each of the shaft cores facing the circuit board is provided with a plurality of abutting protrusions, the plurality of abutting protrusions are provided outside the annular groove at intervals in a circumferential direction of the shaft core, and the plurality of abutting protrusions abuts against the circuit board.

10. The keyboard according to claim 6, wherein the insertion portion is provided with a light-transmitting hole in a radial direction of the shaft core, and the insertion portion is located between the light-emitting element and the light-receiving element for blockage, wherein when the insertion portion slides downwards until the light-transmitting hole is located between the light-emitting element and the light-receiving element, light generated by the light-emitting element passes through the light-transmitting hole to the light-receiving element.

11. The keyboard according to claim 6, wherein the downward surface of the shaft casing is provided with a first light-transmitting groove, the first light-transmitting groove is located on a side of the shaft cavity away from the groove, an upward surface of the shaft casing is provided with a second light-transmitting groove corresponding to the first light-transmitting groove in position, and a light-transmitting board is formed between the first light-transmitting groove and the second light-transmitting groove; and the circuit board is provided with a plurality of lamp beads, a position of each of the plurality of lamp beads corresponds to a position of a corresponding first light-transmitting groove, and light emitted by each of the plurality of lamp beads is transmitted through the light-transmitting board to a corresponding keycap.

12. The keyboard according to claim 6, wherein the shaft casing is integrally formed with the flat board.

* * * * *